US006403169B1

(12) United States Patent
Hardwick et al.

(10) Patent No.: US 6,403,169 B1
(45) Date of Patent: Jun. 11, 2002

(54) METHOD OF PRODUCING A SECURITY DOCUMENT

(75) Inventors: Bruce Alfred Hardwick; Gary Power, both of Victoria (AU)

(73) Assignee: Securency Pty Ltd., Craigieburn (AU)

( * ) Notice: Subject to any disclaimer, the term of this patent is extended or adjusted under 35 U.S.C. 154(b) by 0 days.

(21) Appl. No.: 09/445,677

(22) PCT Filed: Jan. 10, 1998

(86) PCT No.: PCT/AU98/00438

§ 371 (c)(1),
(2), (4) Date: Mar. 13, 2000

(87) PCT Pub. No.: WO98/56596

PCT Pub. Date: Dec. 17, 1998

(30) Foreign Application Priority Data

Jun. 11, 1997 (AU) ..... PO7283

(51) Int. Cl.[7] ..... H01F 1/00

(52) U.S. Cl. ..... 427/548; 427/130; 427/131; 427/356; 427/359; 427/370; 427/385.5; 427/398.1; 427/547; 427/549; 427/550; 427/598; 427/599

(58) Field of Search ..... 427/128–132, 427/547, 548, 549, 550, 598, 599, 398.1, 385.5, 356, 359, 370

(56) References Cited

U.S. PATENT DOCUMENTS

| | | | | |
|---|---|---|---|---|
| 3,878,367 A | | 4/1975 | Fayling et al. | 235/61.12 M |
| 4,180,207 A | | 12/1979 | Lee | 235/493 |
| 4,186,944 A | | 2/1980 | Pearce | 283/8 R |
| 4,585,535 A | * | 4/1986 | Sher et al. | |
| 4,743,490 A | | 5/1988 | Fayling et al. | 428/212 |
| 5,383,687 A | | 1/1995 | Suess et al. | 283/86 |

FOREIGN PATENT DOCUMENTS

| | | |
|---|---|---|
| GB | 2176746 | 1/1987 |

* cited by examiner

*Primary Examiner*—Bernard Pianalto
(74) *Attorney, Agent, or Firm*—Greer, Burns & Crain, Ltd.

(57) ABSTRACT

One aspect of the present invention provides a method of producing a security document, including the steps of:

(a) forming a sheet-like substrate of plastics material having first and second opposing surfaces, (b) coating a first layer of polymer material containing magnetic particles on the first opposing surface, (c) melting at least a portion of the first layer such that the magnetic particles can orient under the influence of a magnetic field, (d) applying the magnetic field so as to form a magnetic watermark, and (e) allowing the first layer portion to cool so as to fix the orientation of the magnetic particles

36 Claims, 2 Drawing Sheets

METHOD OF PRODUCING A SECURITY DOCUMENT

The present invention relates to security documents such as banknotes or the like, and is particularly concerned with providing a security document which includes a magnetic device or watermark for verifying the authenticity of the security document. The invention is also concerned with a method of producing such security documents.

A wide variety of security devices or features for security documents, such as banknotes, travellers cheques or the like have been previously proposed. One such security device is a "magnetic watermark" in which a coating of selectively oriented magnetic particles in a binder is applied to a security document. The magnetic watermark is formed by applying a magnetic field to preselected areas of the coating whilst it is in a liquid state, and then causing the coating to solidify.

U.S. Pat. No. 4,186,944 describes one method of applying such a security device to a paper banknote. According to this method, magnetic particles are firstly mixed with the ink which will be used to apply indicia to the surface of the banknote. After mixing, the ink is poured into a cell, then heated, and placed in a magnetic field to orient the magnetic particles in the cell in a particular pattern or design. The banknote is next brought into contact with the cell so that the wet ink is transferred onto one of its surfaces. The transferred ink is absorbed through the surface of the paper and allowed to cool, which causes the orientation of magnetic particles in the transferred ink to be maintained.

A disadvantage of this method is that, in addition to being complex, it requires the magnetic watermark to be coincident with the printed indicia on the security document, rather than being hidden from visual inspection elsewhere on the document. Moreover, such a method is particularly unsuitable for use in polymer based banknotes, which are formed at least in part from plastics materials, and like security documents. Such documents comprise a flexible film substrate which is coated on one or both sides with an opacifying pigmentary layer. The substrate is then passed through a printing machine to print indicia onto one or both of the opacifying layers. Heating of the ink used to print the relevant indicia on the banknote, so as to allow the orientation of magnetic particles therewithin, could produce a disturbance in the opacifying layer and/or the substrate.

It is therefore desirable to provide a security document and method of producing such security document which allows the convenient application of a magnetic watermark.

It is also desirable to provide a security document and method of producing such security document which enables the orientation of magnetic particles constituting the watermark to be carried out without undue disturbance to the security document itself.

It is further desirable to provide a security document and method of producing such security document which ameliorates or overcomes one or more problems associated with the prior art.

One aspect of the present invention provides a method of producing a security document, comprising the steps of:

(a) forming a sheet-like substrate of plastics material having first and second opposing surfaces, (b) coating a first layer of polymer material containing magnetic particles on said first opposing surface, (c) melting at least a portion of said first layer such that the magnetic particles can orient under the influence of a magnetic field, (d) applying said magnetic field so as to form a magnetic watermark, and (e) allowing said first layer portion to cool so as to fix the orientation of said magnetic particles.

Preferably, the first layer is at least partially transparent.

The first layer may act to protect the security document from wear.

The first layer may include particles acting to improve the adherence of the security document when handled by a user.

The sheet-like substrate preferably comprises a film having first and second opposing sides, and the method may further comprise the step of coating at least one of said first or second opposing sides with an opacifying coating prior to step (c).

The method preferably further comprises the step of forming indicia on at least said first opacifying coating after step (a).

The protective layer may be melted in step (d) by the application of induction heating.

Alternatively, the protective layer in step (d) may be melted by subjecting its outer surface to a heated die or roller.

The heated die or roller may have a shape similar or corresponding to said magnetic watermark, and the heated die may be borne on the surface of a rotatably driven roller.

A further aspect of the present invention provides a method of producing a security document, comprising the steps of:

(a) forming a sheet-like substrate of plastics material having first and second opposing surfaces, (b) coating a first layer of polymer on said first opposing surface, (c) placing magnetic particles in the adhesive of a transfer foil, (d) placing the transfer foil on said first layer, (e) melting at least a portion of said first layer, (f) pressing said transfer foil so that the magnetic particles are transferred into said melted first layer portion, (g) applying said magnetic field so as to orient said magnetic particles and thereby form a magnetic watermark, and (h) allowing said first layer portion to cool so as to fix the orientation of said magnetic particles.

Preferably, the first layer is at least partially transparent.

The first layer may act to protect the security document from wear.

The first layer may include particles acting to improve the adherence of the security document when handled by a user.

The sheet-like substrate may comprise a film having first and second opposing sides, said method further comprising the step of coating at least one of said first or second opposing sides with an opacifying coating prior to step (b).

The method may further comprise the step of forming indicia on at least said first opacifying coating after step (a).

Yet another aspect of the present invention provides a method of producing a security document, comprising the steps of:

(a) forming a sheet-like substrate of plastics material having first and second opposing outer layers containing magnetic particles, (b) melting at least a portion of one of said outer layers such that the magnetic particles can orient under the influence of a magnetic field, (c) applying said magnetic field so as to form a magnetic watermark, (d) allowing said outer layer portion to cool so as to fix the orientation of said magnetic particles, and (e) coating a protective layer of polymer material on said outer layer.

The protective layer may be at least partially transparent.

The protective layer may act to protect the security document from wear.

The protective layer may include particles acting to improve the adherence of the security document when handled by a user.

The method may further comprise the step of coating an opacifying layer on said first and second outer layers after step (d).

The method may also comprise the step of forming indicia on said opacifying layer.

The protective layer may be melted in step (d) by the application of induction heating.

Alternatively, the protective layer in step (d) may be melted by subjecting its outer surface to a heated die or roller.

The heated die or roller may have a shape similar or corresponding to said magnetic watermark.

The heated die may be borne on the surface of a rotatably driven roller.

A still further aspect of the present invention provides a method of producing a security document, comprising the steps of:

(a) forming a sheet-like substrate of plastics material having first and second opposing outer layers containing magnetic particles, (b) coating an opacifying layer on said first and second outer layers whilst leaving an un-opacified window area in said opacifying layer, (c) melting at least a portion of one of said outer layers within said window area such that the magnetic particles can orient under the influence of a magnetic field, (d) applying said magnetic field so as to form a magnetic watermark, and (e) allowing said outer layer portion to cool so as to fix the orientation of said magnetic particles.

The protective layer may be at least partially transparent.

The protective layer may act to protect the security document from wear.

The protective layer may include particles acting to improve the adherence of the security document when handled by a user.

The method may further comprise the step of coating an opacifying layer on said first and second outer layers after step (d).

The method may also comprise the step of forming indicia on said opacifying layer.

The protective layer may be melted in step (d) by the application of induction heating.

Alternatively, the protective layer step (d) may be melted by subjecting its outer surface to a heated die or roller.

The heated die or roller may have a shape similar or corresponding to said magnetic watermark.

The heated die may be borne on the surface of a rotatably driven roller.

In order that the present invention may be more readily understood, various embodiments thereof will now be described, by way of example only, with reference to the accompanying drawings, in which:

BRIEF DESCRIPTION OF THE DRAWINGS

Referring now to FIGS. 1 and 2, there is generally shown a banknote 1 having substantially parallel sides 2 and 3 and substantially parallel ends 4 and 5 and comprising a flexible, sheet-like substrate of plastics material 6 having first and second opposing surfaces 7 and 8. Various indicia may be formed on at least one of the first and second opposing surfaces 7 and 8, such as drawings, writing, and other designs well known to all users of banknotes.

Figure 1:
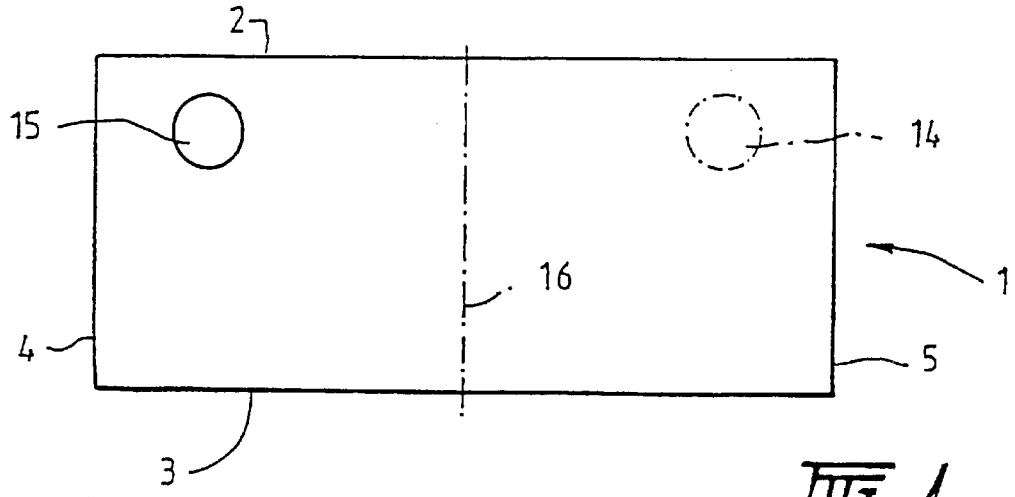
FIG. 1 is a plan view of a banknote in accordance with one embodiment of the present invention.
Figure 2:
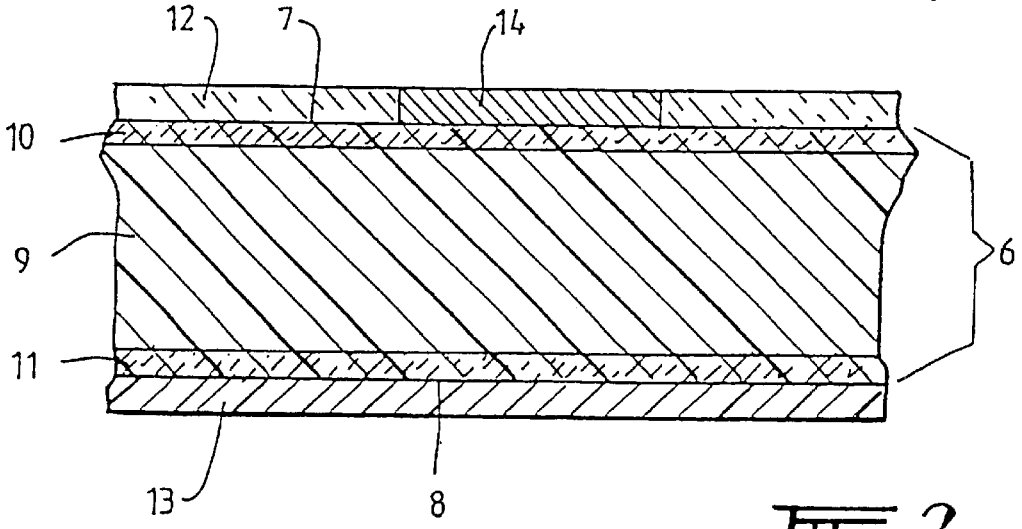
FIG. 2 is a cross-sectional view of a portion of a first embodiment of the banknote of FIG. 1.

The substrate 6 is preferably a composite made up of at least one biaxially oriented polymeric film 9 which is coated on both sides with an opacifying pigmentary coating 10 and 11 comprising a major proportion of pigment in a minor proportion of a cross-liked polymeric binder. A transparent protective coating 12 and 13 is applied to preferably both sides of the substrate 6 in order to protect the banknote 1 from wear. Preferably the transparent protective layer includes silica or like particles so as to improve the adherence of the banknote 1 when it is being handled by a user.

At least a portion of the transparent protective layer 12 and/or 13 contains magnetic particles, that is, particles which are able to have a permanent or semi-permanent magnetic polarity and which adopt a specific magnetic orientation in the presence of a magnetic field. A magnetic watermark, such as that referenced 14 in FIG. 1, may be formed in one or more of the protective layers 12 and 13 by melting at least the outer layers of the protective layer and applying a magnetic field such that the magnetic particles in the melted portion of the layer can adopt a specific magnetic orientation, and then allowing the melted portion of the protected layer to cool so that this magnetic orientation becomes semi-permanent or permanent. In this way, a magnetic watermark may be formed at any location on either or both of the outer protective layers 12 and 13 of the banknote 1 without disturbing the underlying substrate or various indicia printed thereupon. In addition, the location, form and application of the magnetic watermark need have no relation to the printed indicia formed on the substrate 6 nor on the method of fabrication of the substrate 6.

The magnetic watermark 14 may be viewed by commercially available devices for detecting and visualizing magnetic fields. However, in the embodiment of the invention shown in FIG. 1, the banknote 1 comprises verification means 15 at one location to verify or inspect the magnetic watermark 14 at another location when the banknote 1 is folded to superimpose these two locations. Accordingly, when the banknote 1 is folded upon itself generally about a line 16 extending transversely across the note as shown in FIG. 1, the verifying means 15 maybe used to inspect the magnetic watermark 14. The verifying means 15 maybe constituted by a transparent sealed device which contains metallic or like particles whose orientation changes in the presence of a localized magnetic field, which orientation may be visually detected by a user. Alternatively, the verification means 15 may comprise a transparent sealed device which contains material whose optical properties, such as change in the presence of a localized magnetic field such that a reproduction of the watermark 14 is formed by the verification means 15 when the magnetic watermark 14 and the verification means 15 are superimposed.

Figure 3:
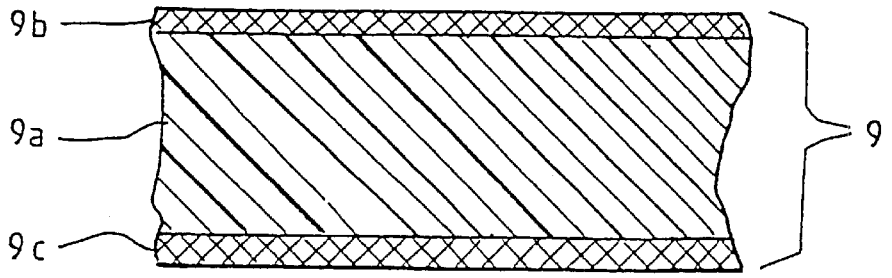
FIG. 3 is a cross-sectional view of a second embodiment of the banknote of FIG. 1 in which a biaxially oriented polymeric film is used in the banknote.

In another embodiment of the invention the magnetic particles are included in a copolymer outer coating 9(*b*), 9(*c*) of FIG. 3 of the biaxially oriented polymeric film, and the magnetic watermark created by melting a portion of the copolymer coating whilst applying a magnetic field and thence allowing the coating to cool whilst still under the influence of the field. The magnetic watermark may be created prior to opacification of the film, or alternatively, after opacification by creating the magnetic watermark in the un-opacified window area of the design.

Of course, the verification means 15 maybe used to verify or inspect a magnetic watermark of another security document in the manner described above.

Figure 4:
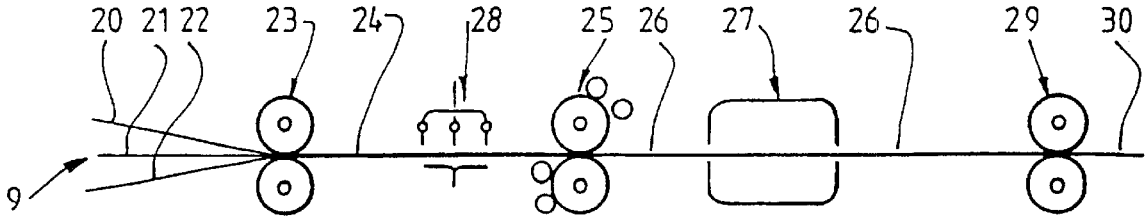
FIG. 4 is a diagrammatic representation of a first portion of a process and apparatus suitable for the production of the banknote of FIG. 1.

Referring now to FIG. 4, the production of banknotes, such as the banknote described above, as a continuous strip or web is shown diagrammatically. The layer or layers of transparent polymer film 9 consist basically of a laminate of three 24 microns sheets 20, 21 and 22 of polymeric film on each side of which a thin coating of heat activated polymer has been deposited. The three sheets are led together through a pair of heated rollers 23 so as to form them into an intimately bonded laminate 24. This laminate is led through a double set of printing rollers 25 which apply a uniform coating of printing ink onto both surfaces of the laminate 24 to form a substrate 26, which is led through a drying oven 27 within which the coating is dried and cured.

Preferably, prior to the coating step, the laminate 24 is subjected to a known surface treatment to improve the adhesion of the printing ink thereto. A suitable treatment may be the use of corona discharge, this being illustrated diagrammatically at 28 in FIG. 3. The treated laminate is coated with a pigmented coating comprising a pigment such as titanium dioxide dispersed within a binder or carrier of heat activated crosslinkable polymeric material. In the coating of the substrate at the rollers 25, a transparent window may be left at intervals corresponding to the location on each banknote where the verification means 15 will be formed.

Finally, the printed laminate 26 is subjected to a further coating step whereby a thin coating of protective and transparent polymeric material is applied to both surfaces of the banknote, this coating serving the combined purpose of providing a soil and solvent resistant outer skin and of providing a binder in which the magnetic particles for forming the magnetic watermark 14 maybe held. In FIG. 3, this thin protective coating is shown as being applied by the pair of rollers 29.

In one embodiment of the invention, magnetic particles are firstly mixed with the transparent polymeric material prior to it being coated onto the outer surfaces of the substrate 26 so that this coating step also acts to apply the magnetic particles to one or more of the surfaces of the substrate 26.

Figure 5:
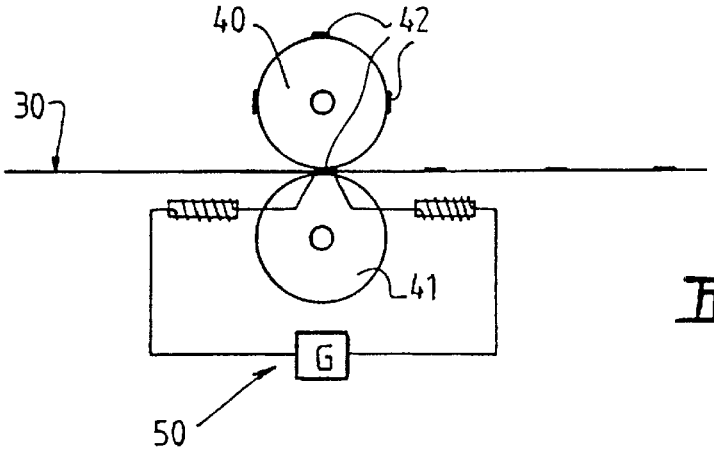
FIG. 5 is a diagrammatic representation of a first embodiment of a second portion of a process and apparatus suitable for the production of the banknote of FIG. 1.

FIG. 5 shows one way in which the magnetic watermark may be applied to banknotes produced by the above described process. This figure shows the substrate 30 at the stage at which it has passed through the rollers 29. In this embodiment, the coated substrate 30 is fed between a pair of rollers 40 and 41. The upper roller 40 bears on its outer surface one or more dies 42. Each die has on its outer face a design or other indicia corresponding to the shape of the magnetic watermark to be formed in the transparent protective layer 12 of the coated substrate 30. In other embodiments, similar means may be used to form a magnetic watermark in the protective layer 13 of the substrate 30. Either the entire upper roller 40 or the dies 42 are heated so that when they rotate and come into contact with the banknote 30 as it passes between the two rollers 40 and 41, that portion of the transparent protective layer 12 coming into contact with the heated die is caused to melt.

In addition, magnetic field generating means 50 are provided for generating a magnetic field in the vicinity of the melted portions of the protective layer 12, 13. When the magnetic field generated by generating means 50 is applied, the magnetic particles in the melted portions of the protective layer 12 are caused to orient along the field lines of that magnetic field.

Subsequently, the upper roller 40 is rotated such that the die 42 is removed from contact with the coated substrate 30 and therefore ceases to heat the protective layer 12. The banknote 30 is then cooled whilst the magnetic field generated by means 50 is maintained so as to allow those melted portions of the protected layer 12 to return to a non-viscous state and thus fix the orientation of the magnetic particles. A magnetic watermark is thus created in which the magnetic particles in those portions of the protective layer 12 underlying the raised surfaces of the die 42 all have a uniform magnetic orientation.

Whilst FIG. 5 shows one manner in which the magnetic watermark may be applied to the banknote 30, it is to be appreciated that several variations or modifications of this described process maybe used. For example, whilst the above described process heats and subsequently melts the upper portions of the transparent protective layer 12 by pressing a heated die into contact with the protective layer 12 induction heating may also be used so that direct contact with the protective layer 12 need not occur. In such an arrangement the die 42 may form part of an electromagnetic flux path which causes the outer layers of the protective coating 12 to melt without direct contact of a heated member.

In addition, whilst the magnetic watermark may be in the form of a visually recognisable design, it may also be in the form of a bar code or other machine readable form. In such cases verification means 15 may not be required to verify or inspect the magnetic watermark.

Figure 6:
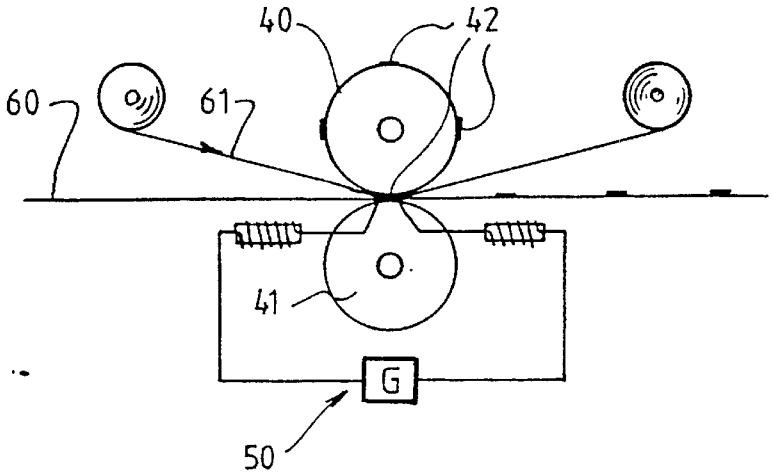
FIG. 6 is a diagrammatic representation of a second embodiment of the second portion of a process and apparatus suitable for the production of the banknote as shown in FIG. 5.

FIG. 6 shown an alternative method of applying the magnetic watermark to the banknote or other security document the subject of the present invention. According to this method, the substrate 26 is firstly produced in accordance with the method described in respect of FIG. 4, that is by the production of a substrate which is subsequently coated with a transparent protective coating 12 with the exception that magnetic particles are not firstly mixed with the material which forms the protective coating 12. Such a coated substrate which contains at this stage no magnetic particles in its transparent protective coating is represented in FIG. 5 by the reference 60.

In addition to the previously described pair of rollers 40 and 41, the heated die 42 and the means 50 for generating a magnetic field, there is also provided a transfer foil 61 which is fed between the pair of rollers 40 and 41 together with, and at the same speed as, the substrate 60. The transfer foil 61 has an adhesive on one of its faces. Magnetic particles are born in the adhesive of the transfer foil 61. As the heated dies 42 rotate, they press the transfer foil firmly against the banknote 60 which causes both the adhesive on the transfer foil and the upper portions of the protective layer to melt. As described above, a magnetic field is applied by the magnetic field generating means 50 so that those portions of the protective layer which have been melted by the die 42, and into which have been transferred magnetic particles, form a magnetic watermark. The heated die is subsequently rotated out of contact with the transfer foil and the protective layer 12, 13 is left to cool in the presence of the applied magnetic field so that the orientation of the magnetic particles forming the magnetic watermark is fixed.

Various modifications of this process maybe implemented. For example, the above described process may be carried out in two steps, the first of which acts to transfer the magnetic particles into the protective layer whilst the second of which is carried out in the applied magnetic field so as to form the magnetic watermark. In such a case, a heated member, such as a roller, may be used to melt the adhesive on the transfer foil and the outer portions of the protective layer of the coated substrate so as to transfer the magnetic particles born in the adhesive into the protective layer of the banknote. A second head or die may then be used to apply the magnetic watermark in the manner described above.

In addition, the first roller could operate in a magnetic field so that the magnetic particles are transferred into the transparent protective layer with a pre-defined magnetic orientation. In a subsequent operation, a second head or die could be used to melt portions of the transparent protective layer in contact with the die and in the presence of the second magnetic field so as to apply a second magnetic orientation to the magnetic particles in those portions of the transparent protective layer melted in the second operation.

It will be appreciated that various embodiments and alterations may be made to the embodiment of the present invention described above without departing from the spirit or scope of the present invention.

What is claimed is:

1. A method of producing a security document, comprising the steps of:

(a) forming a sheet-like substrate of plastics material having first and second opposing surfaces, (b) coating a first layer of polymer material containing magnetic particles on said first opposing surface, (c) melting at least a portion of said first layer within a defined watermark area such that the magnetic particles located within said defined area can orient under the influence of a magnetic field, (d) applying said magnetic field so as to form a magnetic watermark within said defined watermark area and within said first layer, so that, upon said application of said magnetic field to said defined, melted watermark area, the magnetic particles are selectively and uniformly oriented, as opposed to the distinct and non-uniform orientation of particles in portions of said layer not exposed to said melting; and (e) allowing said first layer portion to cool so as to fix the orientation of said magnetic particles within said defined watermark area.

2. A method of producing a security document according to claim 1, wherein the first layer is at least partially transparent.

3. A method of producing a security document according to claim 1, wherein said first layer acts to protect the security document from wear.

4. A method of producing a security document according to claim 3, wherein said first layer includes particles acting to improve the adherence of the security document when handled by a user.

5. A method of producing a security document according to claim 1, wherein said sheet-like substrate comprises a film having first and second opposing sides, said method further comprising the step of coating at least of said first or second opposing sides with an opacifying coating prior to step (c).

6. A method of producing a security document according to claim 5, and further comprising the step of forming indicia on at least said first opacifying coating after step (a).

7. A method of producing a security document according to claim 1, wherein the protective layer is melted in step (d) by the application of induction heating.

8. A method of producing a security document according to claim 1, wherein the protective layer in step (d) is melted by subjecting its outer surface to a heated die or roller.

9. A method of producing a security document according to claim 8, wherein the heated die or roller has a shape similar or corresponding to said magnetic watermark.

10. A method of producing a security document according to claim 8, wherein the heated die is borne on the surface of a rotatably driven roller.

11. A method of producing a security document, comprising the steps of:

(a) forming a sheet-like substrate of plastics material having first and second opposing surfaces, (b) coating a first layer of polymer on said first opposing surface, (c) placing magnetic particles in the adhesive of a transfer foil, (d) placing the transfer foil on said first layer, (e) melting at least a portion of said first layer, (f) pressing said transfer foil so that the magnetic particles are transferred into said melted first layer portion, (g) applying said magnetic field so as to orient said magnetic particles and thereby form a magnetic watermark having boundaries within said first layer, so that, upon said application of said magnetic field within said boundaries, the magnetic particles are selectively and non-uniformly oriented, and (h) allowing said first layer portion to cool so as to fix the orientation of said magnetic particles.

12. A method of producing a security document according to claim 11, wherein the first layer is at least partially transparent.

13. A method of producing a security document according to claim 11, wherein said first layer acts to protect the security document from wear.

14. A method of producing a security document according to claim 13, wherein said first layer includes particles acting to improve the adherence of the security document when handled by a user.

15. A method of producing a security document according to claim 11, wherein said sheet-like substrate comprises a film having first and second opposing sides, said method further comprising the step of coating at least one of said first or second opposing sides with an opacifying coating prior to step (c).

16. A method of producing a security document according to claim 15, and further comprising the step of forming indicia on at least said first opacifying coating after step (a).

17. A method of producing a security document, comprising the steps of:

(a) forming a sheet-like substrate of plastics material having first and second opposing outer layers containing magnetic particles, (b) melting at least a portion of one of said outer layers within a defined watermark area such that the magnetic particles can orient under the influence of a magnetic field, (c) applying said magnetic field so as to form a magnetic watermark within said defined, melted watermark area and within said first layer, so that, upon said application of said magnetic field within said area, the magnetic particles are selectively and uniformly oriented, as opposed to the distinct and non-uniform orientation of particles in portions of said layer not exposed to said melting, (d) allowing said outer layer portion to cool so as to fix the orientation of said magnetic particles within said defined watermark area, and (e) coating a protective layer of polymer material on said outer layer.

18. A method of producing a security document according to claim 17, wherein the protective layer is at least partially transparent.

19. A method of producing a security document according to claim 17, wherein said protective layer acts to protect the security document from wear.

20. A method of producing a security document according to claim 19, wherein said protective layer includes particles acting to improve the adherence of the security document when handled by a user.

21. A method of producing a security document according to claim 17, and further comprising the step of coating an opacifying layer on said first and second outer layers after step (d).

22. A method of producing a security document according to claim 21, and further comprising the step of forming indicia on said opacifying layer.

23. A method of producing a security document according to claim 17, wherein the protective layer is melted in step (d) by the application of induction heating.

24. A method of producing a security document according to claim 17, wherein the protective layer in step (d) is melted by subjecting its outer surface to a heated die or roller.

25. A method of producing a security document according to claim 24, wherein the heated die or roller has a shape similar or corresponding to said magnetic watermark.

26. A method of producing a security document according to claim 24, wherein the heated die is borne on the surface of a rotatably driven roller.

27. A method of producing a security document, comprising the steps of:

(a) forming a sheet-like substrate of plastics material having first and second opposing outer layers containing magnetic particles, (b) coating an opacifying layer on said first and second outer layers while leaving an un-opacified window area in said opacifying layer, (c) melting at least a portion of one of said outer layers within said window area such that the magnetic particles can orient under the influence of a magnetic field, (d) applying said magnetic field so as to form a magnetic watermark having boundaries within said first layer, so that, upon said application of said magnetic field within said boundaries, the magnetic particles are selectively and non-uniformly oriented, and (e) allowing said outer layer portion to cool so as to fix the orientation of said magnetic particles.

28. A method of producing a security document according to claim 27, wherein the protective layer is at least partially transparent.

29. A method of producing a security document according to claim 27, wherein said protective layer acts to protect the security document from wear.

30. A method of producing a security document according to claim 29, wherein said protective layer includes particles acting to improve the adherence of the security document when handled by a user.

31. A method of producing a security document according to claim 27, and further comprising the step of coating an opacifying layer on said first and second outer layers after step (d).

32. A method of producing a security document according to claim 31, and further comprising the step of forming indicia on said opacifying layer.

33. A method of producing a security document according to claim 27, wherein the protective layer is melted in step (d) by the application of induction heating.

34. A method of producing a security document according to claim 27, wherein the protective layer in step (d) is melted by subjecting its outer surface to a heated die or roller.

35. A method of producing a security document according to claim 34, wherein the heated die or roller has a shape similar or corresponding to said magnetic watermark.

36. A method of producing a security document according to claim 34, wherein the heated die is borne on the surface of a rotatably driven roller.

* * * * *